United States Patent [19]

Conley et al.

[11] Patent Number: 5,038,529

[45] Date of Patent: Aug. 13, 1991

[54] ROOF SUPPORT STRUCTURE

[75] Inventors: John L. Conley; Thomas L. Conley; Gerald D. Conley; Howard L. Davis, all of Chino, Calif.

[73] Assignee: Conley's Manufacturing & Sales, Pomona, Calif.

[21] Appl. No.: 501,520

[22] Filed: Mar. 29, 1990

[51] Int. Cl.[5] ..... E04D 13/00

[52] U.S. Cl. ..... 52/14; 52/22; 52/533; 52/543

[58] Field of Search ..... 52/14–16, 52/13, 86, 408–410, 302, 303, 543, 533, 22, 11

[56] References Cited

U.S. PATENT DOCUMENTS

| | | | |
|---|---|---|---|
| 2,688,291 | 9/1954 | Cannard | 52/14 X |
| 2,736,397 | 2/1956 | Colby, Jr. | 52/14 |
| 3,611,649 | 10/1971 | Muller et al. | 52/14 X |
| 4,528,784 | 7/1985 | Simpson et al. | 52/14 |
| 4,817,343 | 4/1989 | Rutledge | 52/22 |

*Primary Examiner*—Richard E. Chilcot, Jr.
*Attorney, Agent, or Firm*—Boniard I. Brown

[57] ABSTRACT

A roof structure having a frame including lower elongate frame members arranged in spaced parallel relation and supporting upper elongate frame members arranged in spaced parallel relation along and extending transverse to the lower members, a roof supported on the upper members, and a condensate collection system for collecting and disposing of condensate running along the underside of the roof including upwardly opening condensate collection channels extending along the upper frame members disposed in condensate collecting relation to the underside of the roof, upwardly opening condensate drainage channels extending along the lower frame members, and means which both secure the frame members to one another at their intersections and conduct condensate from the collection channels to the drainage channels.

23 Claims, 2 Drawing Sheets

FIG—.3
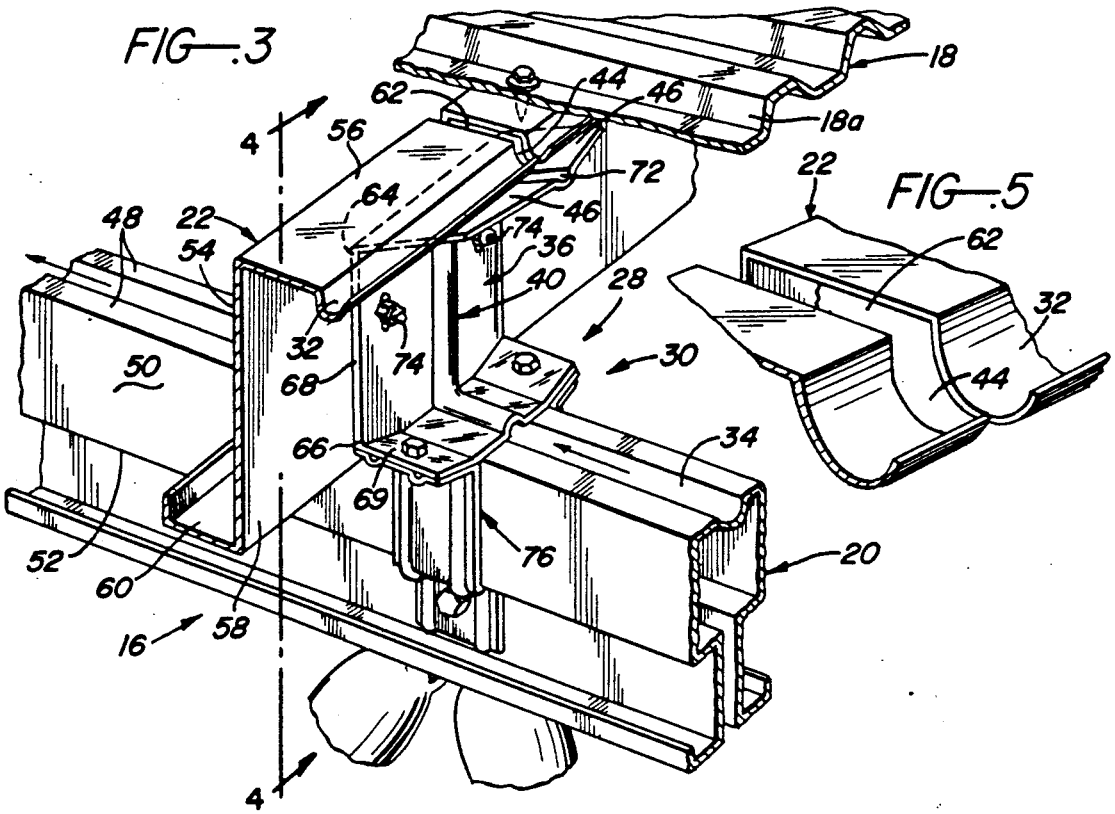
FIG—.5
FIG—.4
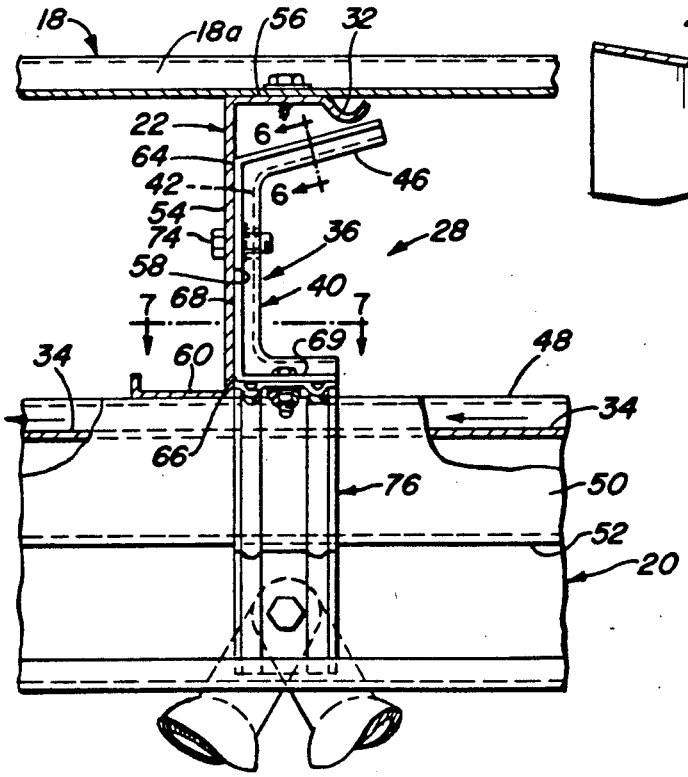
FIG—.6
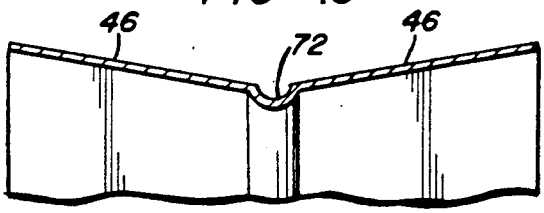
FIG—.7
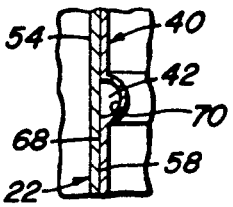

ROOF SUPPORT STRUCTURE

BACKGROUND OF THE INVENTION

1. Field of the Invention

This invention relates generally to roof structures and more particularly to an improved relatively light weight, low cost roof structure of the class disclosed in my prior U.S. Pat. No. 4,676,034 and to an improved support structure for the roof material.

2. Discussion of the Prior Art

Roof structures of the class to which this invention pertains are primarily intended for applications which require relatively large floor area coverage, such as commercial greenhouses, swimming pool enclosures and the like. The prior art is replete, of course, with a vast assortment such roof structures. One example of a roof structure of this kind is disclosed in U.S. Pat. No. 3,488,899. This patented roof structure, however, is relatively heavy, costly to construct, and presents the condensate problem discussed below. My prior U.S. Pat. No. 4,676,034 discloses an improved roof structure which overcomes these disadvantages.

My prior patented roof structure includes a roof proper constructed of a relatively thin, light weight, sheet-like roofing material and a relatively light weight frame below and supporting the roof. The roof supporting frame includes a plurality of long slender lower frame members which are supported in spaced parallel relation on upstanding posts, walls or the like and long slender upper frame members which extend transverse to and are supported on and rigidly joined to the lower frame members with the upper members disposed in spaced parallel relation along the lower members. The roofing material overlies and is directly supported on these upper frame members. For reasons of strength, rain runoff, and appearance, the roof is supported in such a way that it slopes. The particular roof structure illustrated in my prior patent, for example, is an arched roof structure having a roof proper composed of fiberglass panels and a roof supporting frame which supports the roof in an arch-like configuration, such that the roof has a central crest and two arcuate portions which extend with a downward slope in opposite directions from the crest to lower roof edges .

A roof structure of this type presents the problem that condensate tends to form on the under side of the roof, that is on the bottom surface of the sheet-like roofing material and run downwardly toward the lower roof edges. Gutters are placed along these lower edges to collect and carry off the condensate. One disadvantage of the roof structure disclosed in U.S. Pat. No. 3,488,899 resides in the fact that the condensate collection system is somewhat ineffective with the result that condensate tends to drip into the space below the roof.

My prior U.S. Pat. No. 4,676,034 solves this condensate drip problem in the following way. The lower frame members of the roof supporting frame extend parallel to the direction in which condensate tends to run downwardly along the underside of the roof and contain in their upper sides a longitudinal, upwardly opening channel referred to herein as a condensate drainage channel. The upper frame members extend transverse to the lower frame members and hence also transverse to said direction in which condensate tends to run downwardly along the underside of the roof. The upper sides of these upper frame members contain longitudinal channels, referred to herein as condensate collection channels, which open upwardly toward and are disposed in condensate collecting relation to the underside of the roof, such that condensate running downwardly along the underside enters these collection channels. Condensate is conducted from the condensate collection channels to the condensate drainage channels by wires which extend between and along which condensate flows from the collection channels to the drainage channels. The condensate then flows downwardly thru the drainage channels to gutters at the lower ends of the latter channels.

When properly constructed, this condensate collection system of my prior patent is very effective from the standpoint of its ability to collect and dispose of the condensate which tends to form on the underside of the roof and thereby prevent dripping of the condensate into the underlying space below the roof. The collection system, however, has one disadvantage which this invention overcomes. This disadvantage resides in the fact that workmen installing my patented roof structure often forget to or improperly install the condensate conducting wires between the collection and drainage channels. This reduces the effectiveness of the condensate collection system and causes dripping of condensate into the underlying space in direct proportion to the number of condensate collection wires which are omitted or improperly installed.

SUMMARY OF THE INVENTION

This invention provides an improved roof structure and supporting frame therefore which are substantially identical to those of my above described prior U.S. Pat. No. 4,676,034 except that the improved roof and supporting frame embody an improved arrangement for conducting condensate from the condensate collection channels to the condensate drainage channels which avoids the above discussed disadvantage of my prior condensate collection system. According to the present invention, condensate is conducted from the collection channels to the adjacent drainage channels by condensate conduction means which cannot be omitted or improperly installed. These condensate conduction means define condensate drain passages having upper ends through which they receive condensate from the adjacent collection channels through drain openings in these channels and lower ends through which the condensate is discharged to the adjacent drainage channels.

According to one feature of the invention, the drain passage defining means comprise structural members which serve the additional function of rigidly joining the respective upper and lower frame members in such a way that it is impossible to forget to or improperly install the drain passage defining members. According to another feature of the invention, the drain passage defining means comprise members having side surfaces which seat against side surfaces of their respective upper frame members, and one surface of each pair of seating surfaces is recessed to form the drain passages between the surfaces. In the disclosed embodiment of the invention, the condensate collection channel in each upper frame member is located laterally beyond the side surface of its respective upper frame member and the corresponding drain passages, and condensate is conducted from the collection channel to the upper ends of the drain passages by troughs which are located below and receive condensate through the collection channel drain openings and conduct the condensate to the upper ends of the drain passages.

In the presently preferred embodiment of the invention which is described herein, the upper and lower frame members are sheet metal channel members, and the condensate conduction means comprise sheet metal, drain-passage-defining brackets which are secured to and rigidly join the respective upper and lower channel members into an integral frame structure. Each bracket includes a first bracket portion which has a side surface seating against a side surface of its respective upper frame channel member and contains a recess forming a condensate drain passage between the surfaces and a second bracket portion which extends laterally from the upper edge of the first bracket portion and forms an upwardly opening trough for conducting condensate from the adjacent drain opening in the respective condensate collection channel to the upper end of the drain passage.

BRIEF DESCRIPTION OF THE DRAWINGS

FIG. 3 is an enlarged fragmentary perspective view of the roof structure showing two roof supporting frame members, roofing material, and a condensate conducting bracket of the invention;

FIG. 4 is a section on line 4—4 in FIG. 3;

FIG. 5 is a further enlarged fragmentary perspective view of a portion of FIG. 3;

FIG. 6 is a section taken on line 6—6 FIG. 4; and

FIG. 7 is a section taken on line 7—7 in FIG. 4.

DESCRIPTION OF THE PREFERRED EMBODIMENT

Figure 1:
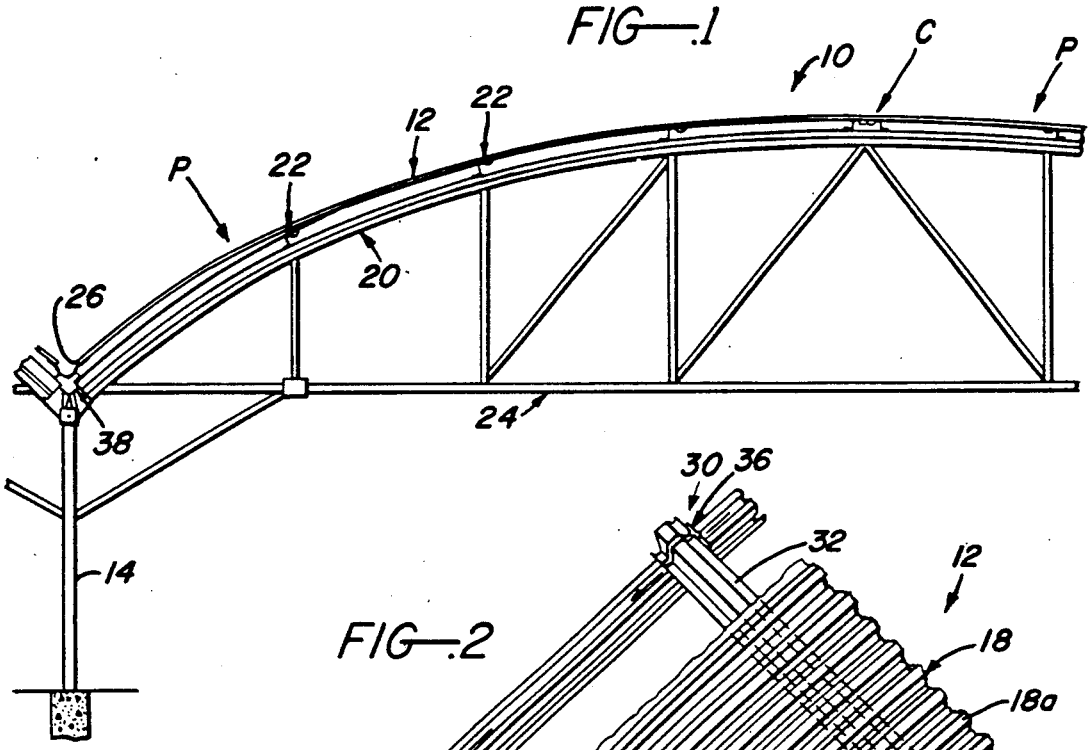
FIG. 1 is a vertical section through an enclosure including a roof structure according to this invention.
Figure 2:
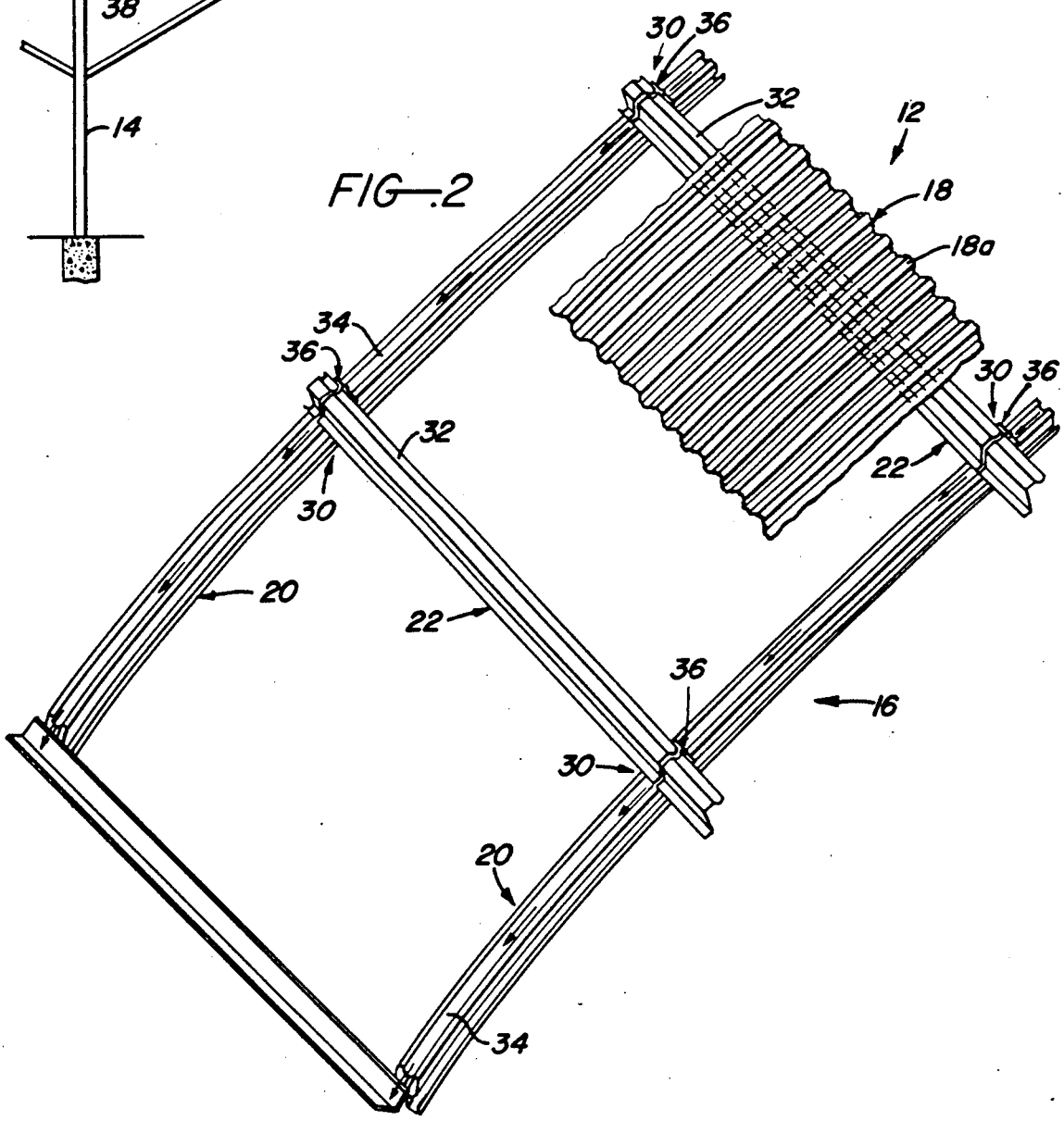
FIG. 2 is a fragmentary perspective view of the roof structure.

Turning now to these drawings and first to FIG. 1, the illustrated enclosure 10 comprises an improved roof structure 12 according to this invention supported a distance above the ground on upstanding columns 14. Roof structure 12 includes a roof supporting frame 16 and a roof 18 proper supported on the frame. The supporting frame 16 includes frame members 20, 22 which are rigidly joined to one another in the manner hereafter described and supported by a truss frame structure 24 which supports the frame 16 and roof 18 in a desired roof configuration. In the particular enclosure 10 illustrated, the truss frame structure 24 supports the frame 16 and roof 18 in a generally arch-like configuration such that the roof has a central crest C and downwardly sloping arcuate portions P which extend in opposite lateral directions from the crest with a downward curvature about a common axis under the crest normal to the plane of the paper in FIG. 1 and terminate at lower longitudinal edges 26 parallel to the axis. The frame members 20 are disposed in planes normal to this axis and conform to the curvature of the roof 18. The frame members 22 are straight and parallel the axis and extend transverse to the frame members 20.

This invention is concerned primarily with the improved roof structure 12 including the roof supporting frame 16 and roof 18. As mentioned earlier and discussed in more detail later, roof structures of this general kind are prone to the condensation of moisture on the underside of the roofing material which, in this invention, is the material of the roof 18. When the roof slopes, as does the roof 18, this condensate tends to flow or run downwardly along the underside of the roof toward its lowermost edges, i.e. edges 26 in the drawings. The primary contribution of this invention resides in an improved condensate collection system 28 which is embodied in the roof structure 12 for collecting and disposing of this condensate so as to avoid dripping of the condensate into the space below the roof.

The improved roof structure 12 and its condensate collection system 28 will now be described by reference particularly to FIGS. 2–7. It should be noted at the outset of this description that except for this improved condensate collection system, the roof structure 12, including its frame members 20, 22, and roof 18, and indeed the rest of the enclosure 10 in FIG. 1, are substantially identical to those of my prior U.S. Pat. No. 4,676,034. For this reason, the description of the parts of the present improved roof structure 12 which are identical to those of my prior patent will be somewhat abreviated in the following description of the roof structure 12.

The lower frame members 20 are arranged in spaced, generally parallel relation to one another. The upper frame members 22 are also arranged in spaced, generally parallel relation to one another and are located above the lower frame members with the upper members spaced along and extending transverse to the lower members. Accordingly, the upper and lower frame members cross one another at intersections 30 spaced about the frame 16. The roof 18 overlies and is supported on the upper frame members 22. As explained earlier, the roof is composed of relatively thin lightweight sheet-like roofing material so as to provide a relatively inexpensive, light weight roof structure. The particular roof illustrated, for example; comprises corrugated metal of fiberglass panels 18*a* extending transverse to and disposed edge to edge along the upper frame members. These panels are secured to the upper frame members in any convenient way, such as by the illustrated screws.

The use of such thin sheet material for the roof 18 without any barrier below the roof has the disadvantage mentioned earlier, namely condensation of moisture on the underside of the roof which can drip into the underlying enclosure space. The improved condensate collection system 28 of this invention collects and disposes of this condensate in such a way as to minimize or eliminate such condensate dripping. This condensate collection system includes an upwardly opening longitudinal condensate collection channel 32 in at least some of the upper frame members 22, an upwardly opening longitudinal condensate drainage channel 34 in at least some of the lower frame members 20, and means 36 at each of at least certain of the frame intersections 30 for conducting condensate from the collection channels in the adjacent upper frame members to the drainage channels in the adjacent lower frame members. In the roof structure 12 illustrated, all of the lower frame members contain drainage channels, all of the upper frame members contain collection channels, and all of the frame intersections has a condensate conducting means. Condensate flows downwardly through the drainage channels to gutters 38 extending along the lower roof edges 26 which then convey the condensate to the ground or other condensate receiver.

According to one feature of this invention the condensate conducting means 36 includes means 40 defining a condensate drain passage 42 having an upper end which receives condensate from the adjacent collection channel 32 through a drain opening 44 in the bottom of the channel and a lower end opening to the adjacent condensate drainage channel 34. According to another feature of the invention, each condensate conducting means 36 is a structural member which is rigidly secured to both adjacent lower and upper frame members 20, 22 and rigidly joins the members to form an integral supporting frame 16. As shown in the drawings and will be explained shortly, the condensate collection channels 32 are laterally offset from their corresponding drain passages 42. According to a further feature of the invention, each condensate conducting means 36 comprises means 46 for conducting condensate from the adjacent collection channel to the upper end of the corresponding drain passage.

Referring now in more detail to the drawings, each lower frame member 20 is a sheet metal channel member including an upper web 48 containing a central longitudinal recess which forms the condensate drainage channel 34 of the member, and depending flanges 50 along the longitudinal edges of the web having inset lower portions forming downwardly facing longitudinal shoulders 52. Each upper frame member 22 is also a sheet metal channel member and includes a web 54, a flange 56 along the normally upper edge of and projecting laterally beyond one side face 58 of the web, and a flange 60 along the lower edge of and projecting laterally beyond the opposite side of the web. The laterally outer portion of the upper flange 56 is shaped to form the condensate collection channel 32 of the member. The upper flange 56 has slots 62 at positions which are spaced along the flange to coincide with the frame intersections 30 and extend through the collection channel to form the collection channel drain openings 44. Each upper frame or channel member 22 is supported on the underlying lower frame or channel members 20 with the lower flange of the upper member resting on the upper webs 48 of the lower members, as best shown in FIG. 3.

Except for the improved condensate conducting means 36, which constitutes a major contribution of this invention, the roof structure 10 is essentially identical to that of my prior U.S. Pat. No. 4,676,034. As noted above, each of at least some of the frame intersections 30 has a condensate conducting means 36 for conducting condensate from the adjacent condensate collection channel 32 to the adjacent condensate drainage channel 34 and including means 40 defining a drain passage 42 and means 46 for conducting condensate from the collection channel to the upper end of the drain passage.

Considering the lower and upper frame or channel members 20, 22 at each frame intersection 30 having a condensate conducting means 36 to be first and second structural members, the presently preferred condensate conducting means illustrated is essentially a third structural member in the form of a sheet metal bracket. Bracket includes a first bracket portion which constitutes the drain passage defining means 40 and a second bracket portion which constitutes the means 46 for conducting condensate from the adjacent collection channel 32 to the upper end of the corresponding drain passage 42.

The first bracket portion 40 is substantially flat and has normally upper and lower edges 64, 66 and a side surface 68 extending between these edges which seats against the side surface 58 of the adjacent upper frame or channel member 22. Along the lower edge 66 is a flange 69 which seats on the upper web 48 of the adjacent lower frame or channel member 20. Bracket side surface 68 contains a recess 70 extending between and opening endwise at the edges 64, 66 and opening laterally toward the frame member side surface 58 to form the drain passage 42. The second bracket portion 46 extends laterally from the upper edge 64 of the first bracket portion 40 and beyond the side of the latter portion opposite its side surface 68 and toward the adjacent collection channel 32. This second bracket portion is shaped in the manner shown to form a trough located below and opening upwardly toward the adjacent collection channel drain opening 44. The trough 46 has a downward slope toward and has a groove 72 along its bottom extending to the upper end of the drain passage 42. Accordingly, condensate draining from each collection channel 32 through a drain opening 44 drips into the underlying trough 46, then runs along the trough to the upper end of the adjacent drain passage 42, and then passes downwardly through the drain passage to the corresponding drainage channel 34. As noted earlier, the condensate thus entering each drainage channel flows downwardly through the latter channel to the corresponding gutter 38 which then carries the condensate to the ground or other receiver.

In accordance with the teachings of my prior U.S. Pat. No. 4,676,034, each of the upper frame or channel members 22 is arranged so that its collection channel 32 is located along the uphill side of the member, that is the side of the member which faces in the upward direction along the underside of the roof 18 and toward its crest. Accordingly, each upper frame member tends to obstruct condensate flow along the underside of the roof past that member and thereby induce entrance of the condensate into the its collection channel.

According to a feature of the invention, each condensate conducting bracket 36 is a structural member which is secured to both adjacent lower and upper frame members 20, 22 and rigidly joins these members into an integral frame structure. In the preferred roof structure 10 illustrated, this is accomplished by bolts 74 passing through the bracket portion 40 and the web 54 of the upper frame member 22 and by straps 76 bolted to the lower frame member 20 and the bracket flange 69.

The inventors claim:

1. In a frame for supporting a roof having an underside on which condensate tends to form, the combination comprising:

a normally upper elongate frame member having a normally upwardly opening longitudinal condensate collection channel and adapted to be located below and in supporting relation to said roof with said collection channel disposed in condensate collecting relation to the underside of the roof for collecting condensate running along the underside to the channel, a normally lower elongate frame member located below and in supporting relation to said upper frame member and having a normally upwardly opening longitudinal condensate drainage channel, and means for conducting condensate from said collection channel to said drainage channel comprising a drain opening in said collection channel through which condensate drains from said collection channel, and means defining a drain passage having a normally upper end which receives condensate from said collection channel through said drain opening and a normally lower end through which condensate flows from said passage to said drainage channel.

2. The combination according to claim 1, wherein:

said drain passage defining means comprises a structural member which is secured to both frame members and rigidly joins the frame members into an integral frame structure.

3. The combination according to claim 1, wherein:

said upper frame member has a normally upper longitudinal edge to be disposed in supporting relation to said roof, a normally lower longitudinal edge disposed in supporting relation to said lower frame member, and a side surface extending between said edges, said collection channel extends along said upper longitudinal edge of said upper frame member, and said drain passage defining means comprises a third member having a side surface, means securing said third member to at least one of said frame members with said side surface of said third member seating against said side surface of said upper frame member, and an elongate channel-like recess in one of said side surfaces opening laterally toward the other side surface so as to form said drain passage between said side surfaces.

4. The combination according to claim 3, wherein:

said third member is a structural member which is secured to both frame members and rigidly joins the frame members into an integral frame structure.

5. The combination according to claim 3 wherein:

said side surface of said upper frame member faces in one lateral direction of the upper member, said collection channel is offset in said one lateral direction from said side surface of said upper frame member, the normally lower end of said drain passage opens to said drainage channel, and said condensate conducting means includes means for conducting condensate from said drain opening to the upper end of said drain passage.

6. The combination according to claim 5 wherein:

each means for conducting condensate from said drain opening to the upper end of said drain passage comprises a trough normally located below and opening upwardly toward said drain opening and having a normally downward slope toward the upper end of said drain passage.

7. The combination according to claim 5 wherein:

each means for conducting condensate from said drain opening to the upper end of said drain passage comprises a trough on said third member normally located below and opening upwardly toward said drain opening and having a normally downward slope toward the upper end of said drain passage.

8. The combination according to claim 3 wherein:

said upper frame member comprises an elongate sheet channel member including a web which has normally upper and lower longitudinal edges and one side of which constitutes said side surface of said upper frame member, and a flange along said upper web edge which projects laterally beyond said one side of said latter web and forms said collecting channel laterally beyond said side surface of said latter web, said lower frame member comprises an elongate sheet metal channel member including a normally upper web which has longitudinal edges and a normally upwardly opening longitudinal recess between said upper web portion edges forming said drainage channel, and depending flanges along said web edges, and said third member comprises a sheet metal barcket including a first bracket portion which has normally upper and lower edges and one side of which constitutes said side surface of said third member and contains said drain passage defining recess with the latter recess extending between said latter edges and opening endwise at one end toward said flange of said upper frame support member and at its other end to said drainage channel, and a second bracket portion which extends laterally from said upper edge of said first bracket portion with a normally downward slope toward the latter edge and forms a trough normally located below and opening upwardly toward said drain opening of said collection channel, whereby condensate may flow from said collection channel through said drain opening to said trough, then along said trough to the normally upper end of said drain passage, and then through said drain passage to said drainage channel.

9. The combination according to claim 8 wherein:

said bracket is secured to both channel members and rigidly joins said channel members into an integral frame structure.

10. The combination according to claim 1 wherein:

said combination includes a plurality of said lower frame members disposed in spaced parallel relation, a plurality of second frame members disposed in spaced parallel relation along and extending transverse to said first support members, whereby said upper and lower frame members cross one another at a plurality of intersections spaced about said frame, and a said condensate conducting means at at least certain of said intersections for conducting condensate from the collection channel of the adjacent upper frame member to the drainage channel of the adjacent lower frame member.

11. The combination according to claim 9 wherein:

said combination includes a plurality of said lower frame members disposed in spaced parallel relation, a plurality of second frame members disposed in spaced parallel relation along and extending transverse to said first support members, whereby said upper and lower frame members cross one another at a plurality of intersections spaced about said frame, and a said condensate conducting means at each of at least certain of said intersections for conducting condensate from the collection channel of the adjacent upper frame member to the drainage channel of the adjacent lower frame member.

12. A roof structure comprising:

a roof which tends to collect condensate on its underside, and a supporting frame below and supporting said roof comprising:

(a) a plurality of normal upper elongate frame members arranged in spaced, generally parallel relation to one another and in supporting relation to said roof, and each frame member containing a normally upwardly opening longitudinal condensate collection channel opening toward and disposed in condensate collecting relation to the underside of said roof such that condensate running along said underside toward said channel tends to collect in and flow longitudinally along said channel, (b) a plurality of normally lower elongate frame members arranged in spaced, generally parallel relation below and in supporting relation to said upper frame members with said lower frame members spaced along and extending transverse to said upper frame members, whereby said frame members cross one another at intersections spaced about said supporting frame, (c) means adjacent at least certain of said intersections for conducting condensate from said collection channel of the adjacent upper frame member to said drainage channel of the adjacent lower frame member comprising a drain opening in the respective collection channel through which condensate drains from the collection channel, and means defining a drain passage having an upper end which receives condensate from the respective collection channel through said drain opening and a lower end through which condensate flows from said passage to said drainage channel in the adjacent lower frame member.

13. The roof structure according to claim 12, wherein:

each drain passage defining means comprises a structural member which is secured to both adjacent frame members and rigidly joins the adjacent frame members into an integral frame structure.

14. The roof structure according to claim 12, wherein:

each normally upper frame member has a normally upper longitudinal edge disposed in supporting relation to said roof, a normally lower longitudinal edge disposed in supporting relation to the adjacent lower frame members, and a side surface extending between said edges, said collection channel in each upper frame member extends along said upper longitudinal edge of the respective upper member member, and each drain passage defining means comprises a third member having a side surface, means securing said third member to at least one of the adjacent upper and lower frame members with said side surface of said third member seating against said side surface of the adjacent upper member, and an elongate channel-like recess in one of said side surfaces opening laterally toward the other side surface so as to form said drain passage between said side surfaces.

15. The roof structure according to claim 14, wherein:

each said third member is a structural member which is secured to both adjacent upper and lower frame members and rigidly joins the adjacent frame members into an integral frame structure.

16. The roof structure according to claim 14 wherein:

said side surface of each upper frame member faces in one lateral direction of the respective upper member, said collection channel in each upper frame member is offset in said one lateral direction from said side surface of the respective upper member, the normally lower end of each drain passage opens to said drainage channel in the adjacent lower frame member, and each condensate conducting means includes means for conducting condensate from the adjacent drain opening to the upper end of the adjacent drain passage.

17. The roof structure according to claim 16 wherein:

each means for conducting condensate from the adjacent drain opening to the upper end of the adjacent drain passage comprises a trough normally located below and opening upwardly toward the adjacent drain opening and having a normally downward slope toward the upper end of the adjacent drain passage.

18. The roof structure according to claim 16 wherein:

each means for conducting condensate from the adjacent drain opening to the upper end of the adjacent drain passage comprises a trough on the adjacent third member normally located below and opening upwardly toward the adjacent drain opening and having a normally downward slope toward the upper end of the adjacent drain passage.

19. The roof structure according to claim 14 wherein:

each lower frame member comprises a first elongate sheet metal channel member including a normally upper web which has longitudinal edges and a normally upwardly opening longitudinal recess between said upper web portion edges forming the respective drainage channel, and depending flanges along said web edges, each upper frame member comprises a second elongate sheet metal channel member including a web which has normally upper and lower longitudinal edges and one side of which constitutes said side surface of the respective upper frame member, and a flange along said upper web edge which projects laterally beyond said one side of said latter web and forms the respective collecting channel laterally beyond said side surface of said latter web, each third member comprises a sheet metal bracket including a first bracket portion which has normally upper and lower edges and one side of which constitutes said side surface of the respective third member and contains the respective drain passage defining recess with the latter recess extending between said latter edges and opening endwise at its upper end toward said flange of the adjacent upper frame member and at its lower end to said drainage channel in the adjacent lower frame member, and a second bracket portion which extends laterally from said upper edge of said first bracket portion with a normally downward slope toward the latter edge and forms a trough normally located below and opening upwardly toward the adjacent drain opening of the adjacent collection channel, whereby condensate may flow from each collection channel through each corresponding drain opening to the underlying trough, then along the latter trough to the normally upper end of the adjacent drain passage, and then through said drain passage to the respective drainage channel.

20. The roof structure according to claim 19 wherein:

each bracket is secured to both adjacent first and second channel members and rigidly joins said adjacent channel members into an integral frame structure.

21. For a roof structure of the character described:

a condensate conducting means having a side surface which has normally upper and lower edges and faces in one direction of said condensate conducting means, an elongate recess in said surface extending between and having open ends at said edges and opening laterally in said one direction, and a normally upwardly opening trough extending from said upper edge in a direction opposite said one direction and with a normally downward slope toward said upper edge.

22. A condensate conducting bracket for a roof support structure of the character described comprising:

a first bracket portion having normally upper and lower edges, a side surface at one side of said bracket portion extending between said edges, and a longitudinal recess in said surface extending between said edges and opening laterally and having open normally upper and lower ends at said upper and lower edges, respectively, and a second bracket portion joined to and extending from said upper edge of said first bracket portion and laterally beyond the opposite side of said first bracket portion and forming a normally upwardly opening trough having a normally downward slope toward said upper edge.

23. A bracket according to claim 22, wherein:

said trough has a longitudinal groove along its bottom opening at one end to the upper end of said recess.

* * * * *